US010662019B2

(12) United States Patent
Nguyen

(10) Patent No.: US 10,662,019 B2
(45) Date of Patent: May 26, 2020

(54) MULTI-TAPE DISPENSER FOR DISPENSING REVERSED-CONJOINED AND/OR NON-REVERSED-CONJOINED TAPE STRIPS

(71) Applicant: Trung Tony Nguyen, Plano, TX (US)

(72) Inventor: Trung Tony Nguyen, Plano, TX (US)

( * ) Notice: Subject to any disclaimer, the term of this patent is extended or adjusted under 35 U.S.C. 154(b) by 0 days.

(21) Appl. No.: 14/670,702

(22) Filed: Mar. 27, 2015

(65) Prior Publication Data

US 2016/0280497 A1 Sep. 29, 2016

Related U.S. Application Data

(60) Provisional application No. 62/075,191, filed on Nov. 4, 2014.

(51) Int. Cl.
*B65H 35/00* (2006.01)

(52) U.S. Cl.
CPC ..... *B65H 35/004* (2013.01); *B65H 35/0033* (2013.01)

(58) Field of Classification Search
CPC ..... B29C 65/00; B29C 35/00; B65H 35/004; B65H 35/0033; B65H 39/16
See application file for complete search history.

(56) References Cited

U.S. PATENT DOCUMENTS 3,768,713 A * 10/1973 Lash ..... A47F 13/04 225/34
4,667,891 A * 5/1987 Pool ..... B05B 15/0456 156/527
4,755,254 A * 7/1988 Bedwell ..... B65H 35/0006 156/516
5,792,312 A * 8/1998 Dotterman ..... B05B 15/0456 156/579
2009/0183837 A1* 7/2009 Andersen ..... B65H 35/004 156/516

* cited by examiner

*Primary Examiner* — Alex B Efta

(57) ABSTRACT

A multi-tape dispenser, for dispensing reversed-conjoined and non-reversed-conjoined adhesive tape end portions from adhesive tape rolls, includes a housing structure configured with at least two rotatable tape-roll hubs installed perpendicularly to the front wall panel and rear wall panel so that at least one of the tape rolls installed on the rotatable tape-roll hubs is reversed and at least one adhesive edge of at least one tape roll is conjoined partially and longitudinally to a reversed adhesive edge of at least one rear tape roll when the reversed-conjoined tape end portions are being dispensed simultaneously on the same path. The multi-tape dispenser may be manufactured for use with a combination of two tape-roll hubs or three tape-roll hubs with tape rolls mounted thereto to produce reversed-conjoined tape end portions. The dispenser can also be used for dispensing at least one tape roll without being conjoined.

14 Claims, 15 Drawing Sheets

MULTI-TAPE DISPENSER FOR DISPENSING REVERSED-CONJOINED AND/OR NON-REVERSED-CONJOINED TAPE STRIPS

The present invention relates to tape dispensers and more particularly to multi-tape dispenser for dispensing reversed-conjoined tape end portions and/or non-reversed conjoined tape end portions by having at least two rolls of tape partially offset with at least one of the tapes is reversed so that an adhesive edge on at least one front tape is conjoined to a reversed adhesive edge on at least one rear tape, or an adhesive edge on the rear tape is conjoined to a reversed adhesive edge on at least one front tape when the tape ends are being dispensed together on the same path. The dispenser can also be used for dispensing at least one tape roll without being conjoined.

BACKGROUND OF THE INVENTION

Description of the Prior Art

Clearly all of the current dispensers on the market, such as tape dispensers for desk top, are for dispensing a single roll of tape or multiple tape rolls to be dispensed individually. Closely related to this invention is the hand-Masker Dispenser by 3M company for dispensing masking tape together with masking paper or folded plastic sheet in a roll, offer certain features that are convenient for certain tasks; However, in certain situations, those dispensers would not be practical when user need to apply tape along the edges and attach the edges of the plastic sheet or paper thereafter. Another closely related invention: Tape dispenser that dispenses overlapping tape and paper structures by Benny Krog Andersen, U.S. Pat. No. 7,921,896; said tape dispensing device includes components that are configured to perform the unrolling lengths of tape in an award method and functionality; such as a lengthy and wavy path for unrolling lengths of tapes being overlapped having most adhesive sides of the tapes being rolled onto surfaces along the way where tape adhesive portions may easily stick onto the surfaces and build up adhesive residue on those surfaces. The device would be more costly to manufacture due to many parts, difficult to be formed as an injection molded device in terms of manufacturability, and therefore would be more costly for the end consumers. On another closely related invention: Roll holder with retention member, by Dan B. Poole, U.S. Pat. No. 5,683,542, having a frame structure that is generally designed for a tape roll and a roll of paper to be partially taped together on the inside edge; however, in order to accommodate two tape rolls to be joined together at the inside edges, the design must be changed to accomplish the dispensing function as described; also, the handle attached onto a frame structure having a holding means called lanyard forming a loop is not practical and cumbersome for the user; thus it is mainly for wearing onto one's wrist.

By way of contrast, the current application is directed to and claims an apparatus of a multi-tape dispenser for dispensing reversed-conjoined tape end portions and nonreversed-conjoined tape end portions being cut into strips. There are at least two rolls of tape to be installed onto the rotatable tape-roll hubs that are positioned on the first wall panel and the second wall panel. The multi-tape dispenser includes an incorporated handle or a cylindrical handle in any of which having a pivotable L-shaped hook installed on the back end of the handle; other parts are configured in and/or assembled so that when dispensing the tape rolls, the tape end portions would become reversed conjoined at the adjacent tape edges; the reversed-conjoined tape end portions can then be cut into strips.

SUMMARY OF THE ADVANTAGES AND SCOPE OF THE INVENTION

First advantage of the present invention is to provide a multi-tape dispenser for dispensing reversed-conjoined tape strips having one of the tape rolls reversed so that at least one adhesive edge on the front tape roll is reversed-conjoined longitudinally to at least one adhesive edge on the rear tape roll when the tape rolls are being dispensed together simultaneously on the same path. At least one front tape roll can be mounted onto the rotatable tape-roll hub positioned on the recessed side and/or the protruding side of the first wall panel, and at least one rear tape roll can be mounted onto the rotatable tape-roll hub positioned on the recessed side and/or the protruding side of the second wall panel so that at least two tape rolls are forming a reversed-conjoined tape portions which would thereafter be cut into strips. The tape rolls can also be arranged in order to dispense tape end portions independently without being conjoined. Currently, there is none of the tape dispensers on the market which dispenses at least two rolls of tape with one of which is reversed so that one tape portion is affixed to a substrate surface and the other conjoined tape portion is exposed so that other material such as plastic sheet or paper can be easily attached to, which is an ideal solution for painters and interior finishers when they need to mask off certain areas to prevent over-sprayed paint, stain, join compound; dust or the like from being blown into or onto.

Second advantage is that the users may use the multi-tape dispenser dispensing reversed-conjoined tape end portions to post pictures, drawings, posters and the like for office, home and/or schools without using pins or spending too much time making a loop out of a one-sided adhesive tape. Pressure sensitive tapes comes in a wide selection of how many days the tapes can be used without leaving residue on the walls without damaging the pictures or posters and, that, tapes can easily be removed.

Third advantage is that the users may use the multi-tape dispenser to dispense three tape end portions with the center tape portion having an adhesive surface on one side and having two tape portions being reversed-conjoined on each edge of the center tape portion; therefore, the adhesive portions of the reversed-conjoined tape portions are on the opposite side of the center tape portion.

and fourth advantage is that users may use the multi-tape dispenser to dispense both reversed-conjoined tape end portions and plain non-reversed-conjoined tape end portions on the same multi-tape dispenser.

Accordingly, this invention has an object to provide a multi-tape dispenser of the character described above which is technically simple to mass produce, simple to assemble and easy for end-users to use. These and other objects will be manifest when considering the following detailed drawing specifications when taken in conjunction with the appended drawing figures.

FIG. is a dimetric view of the multi-tape dispenser showing the housing structure including only one hollow cylinder on the recessed side of the second wall panel, and one hollow cylinder on the recessed side of the first wall panel.

Figure 7:
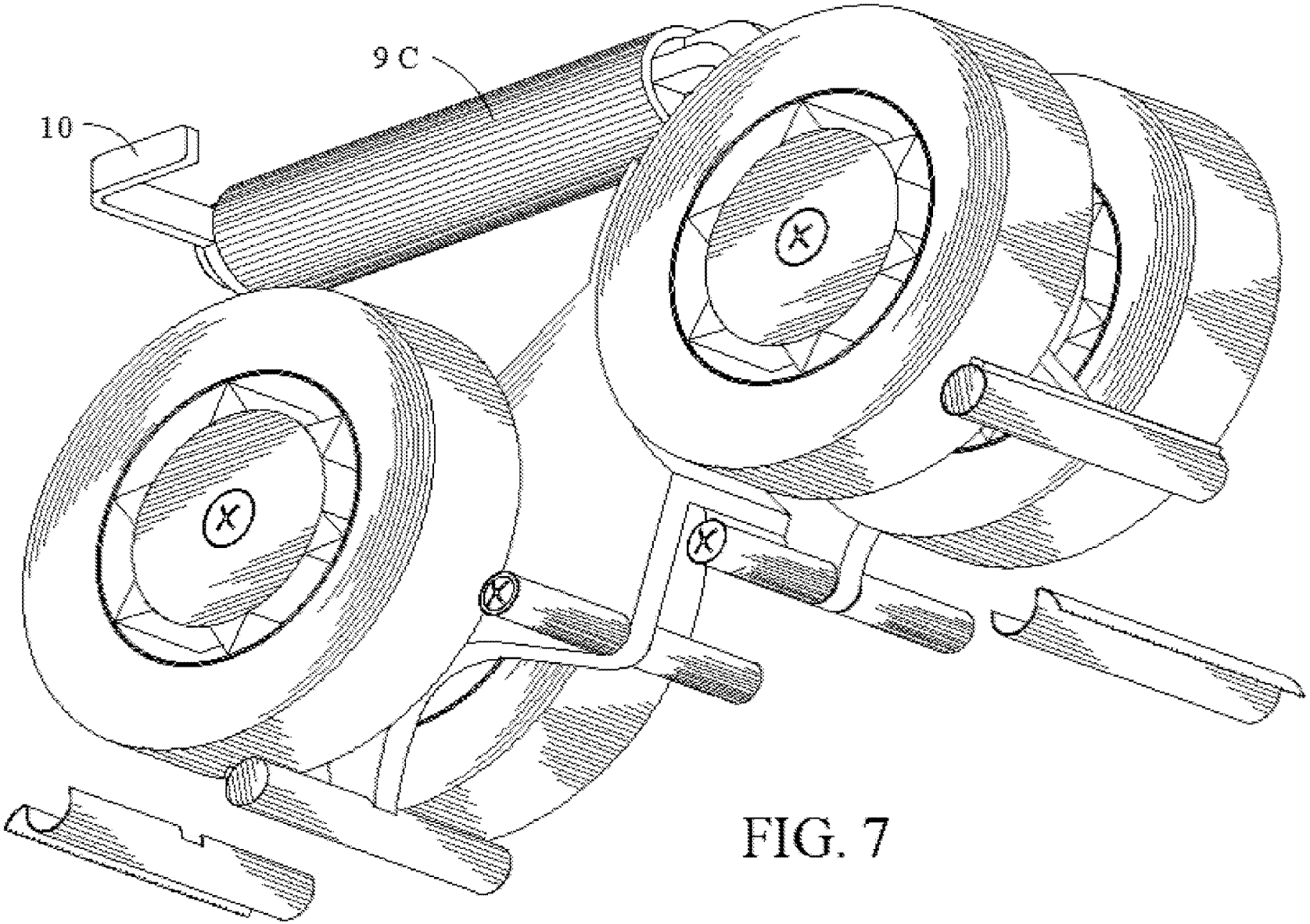

FIG. 7 is a dimetric view of the multi-tape dispenser showing the housing structure with an elongated cylindrical handle with a rotatable L-shaped hook, also with 4 tape rolls mounted.

Figure 8:
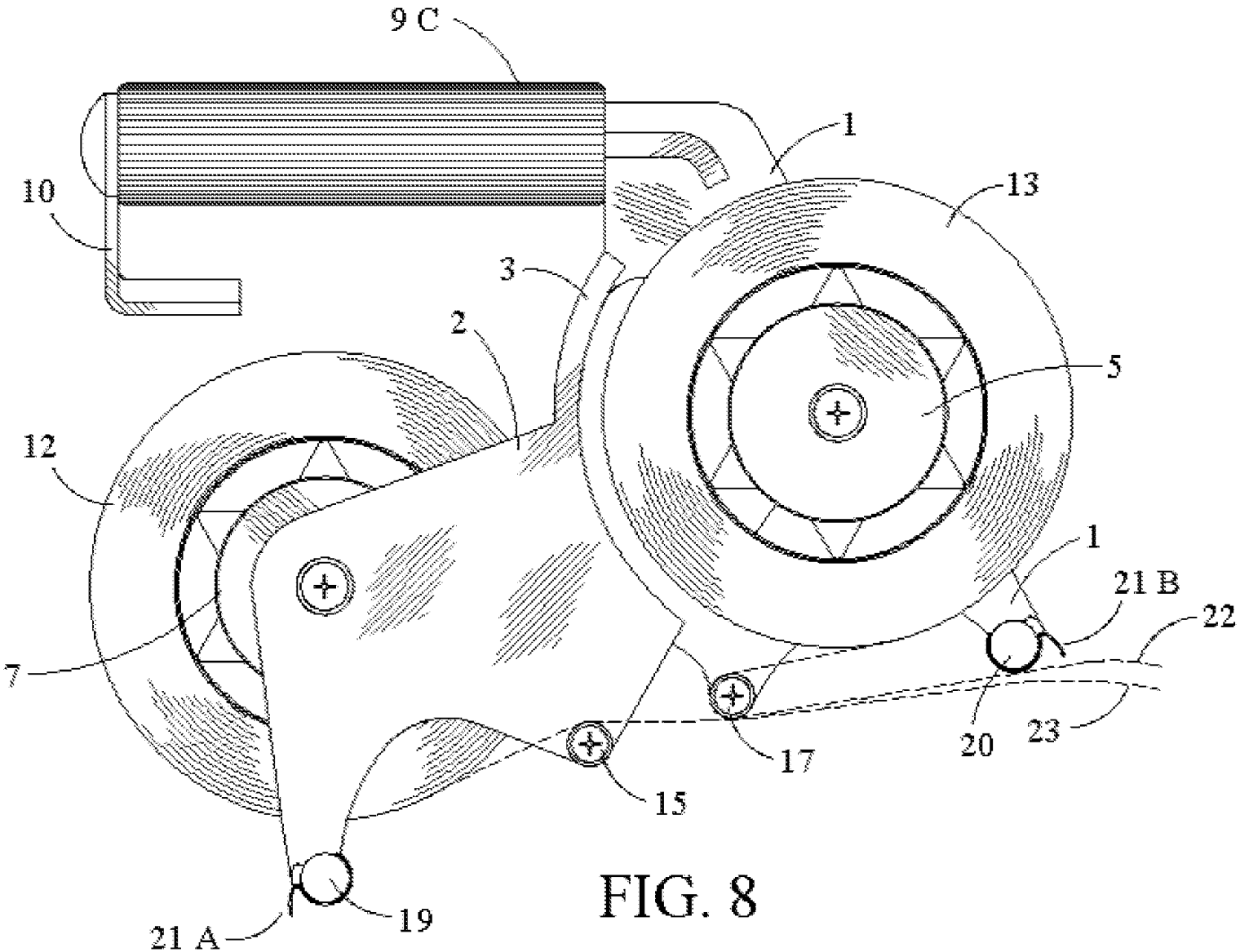

FIG. 8 is a right side view of the multi-tape dispenser with an elongated cylindrical handle and tape rolls mounted.

Figure 9:
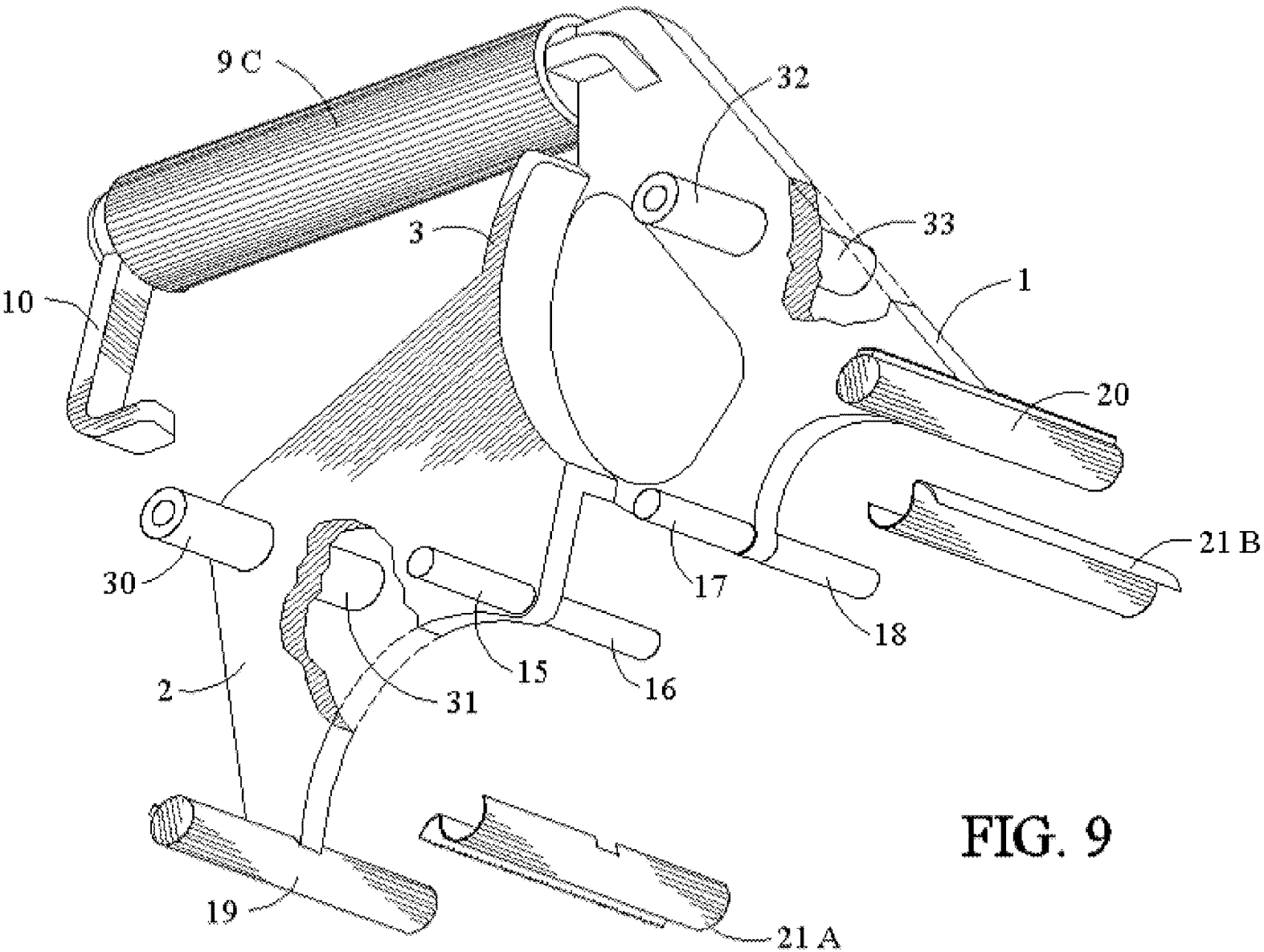

FIG. 9 is dimetric view of the multi-tape dispenser showing the housing structure with an elongated cylindrical handle with a rotatable L-shaped hook, hollow cylinders, cylindrical tape cantilevers, cylindrical tape-cutting-blade receptacles and tape cutting blades.

Figure 10:
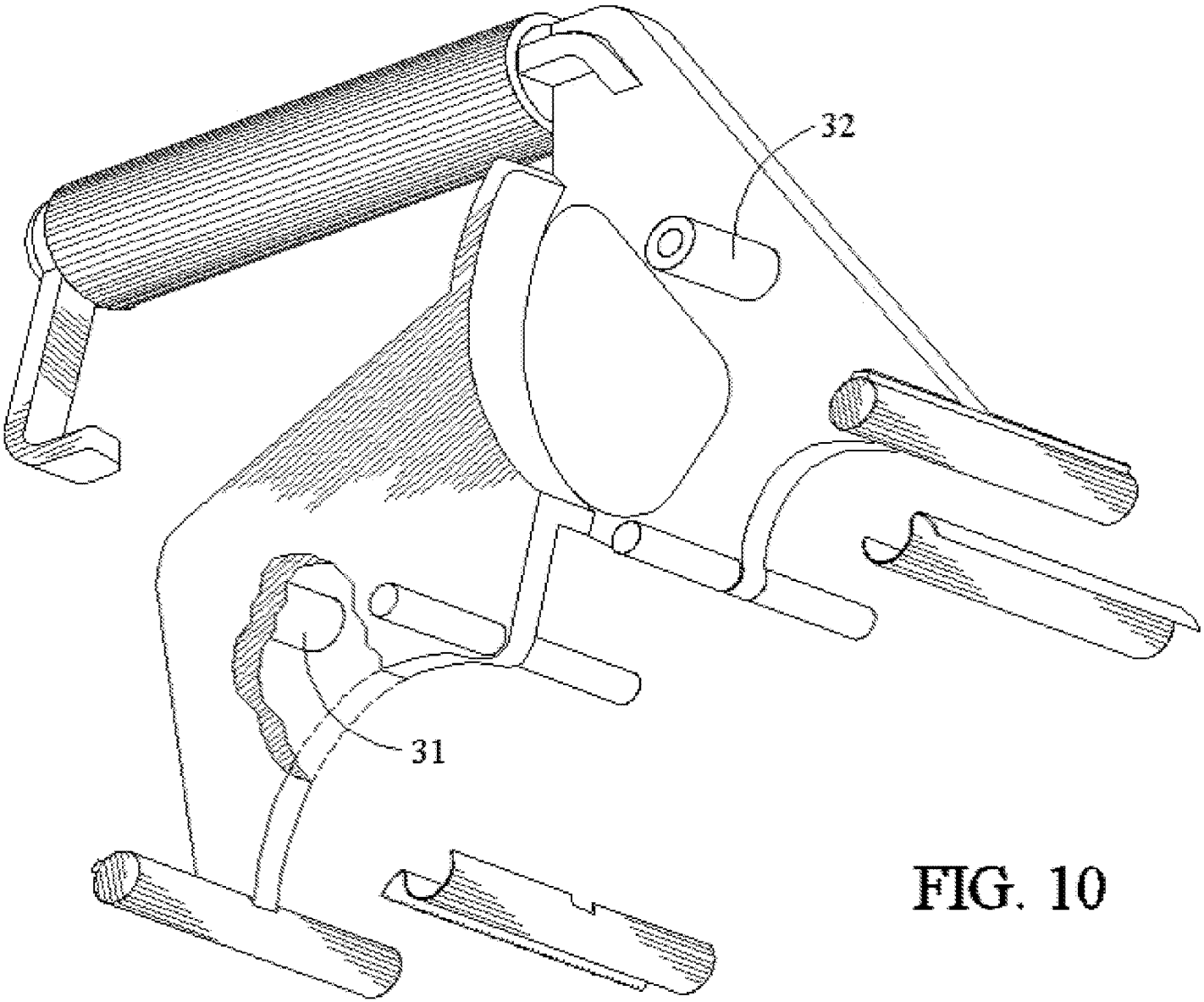

FIG. 10 is a di metric view of the multi-tape dispenser showing the housing structure including only one hollow cylinder on the recessed side of the second wall panel, and one hollow cylinder on the recessed side of the first wall panel.

Figure 11:
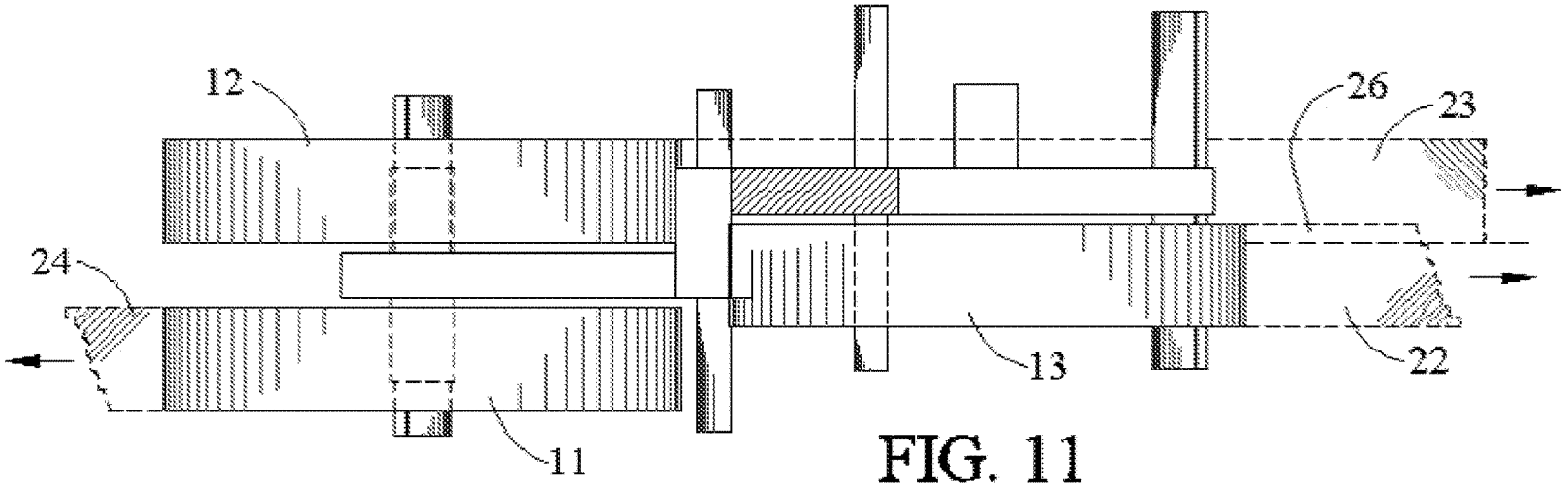

FIG. 11 is a top view of the multi-tape dispenser (without showing the handle) showing the tapes in relation to positions and dispensing path. There is one front tape roll positioned on the recessed side of the first wall panel, and there are two rear tape rolls positioned on the second wall panel having one tape roll on each side of each wall panel. Two tape rolls would form reversed-conjoined tape end portions dispensing toward the front and one tape roll dispensing rearward without being conjoined.

Figure 12:
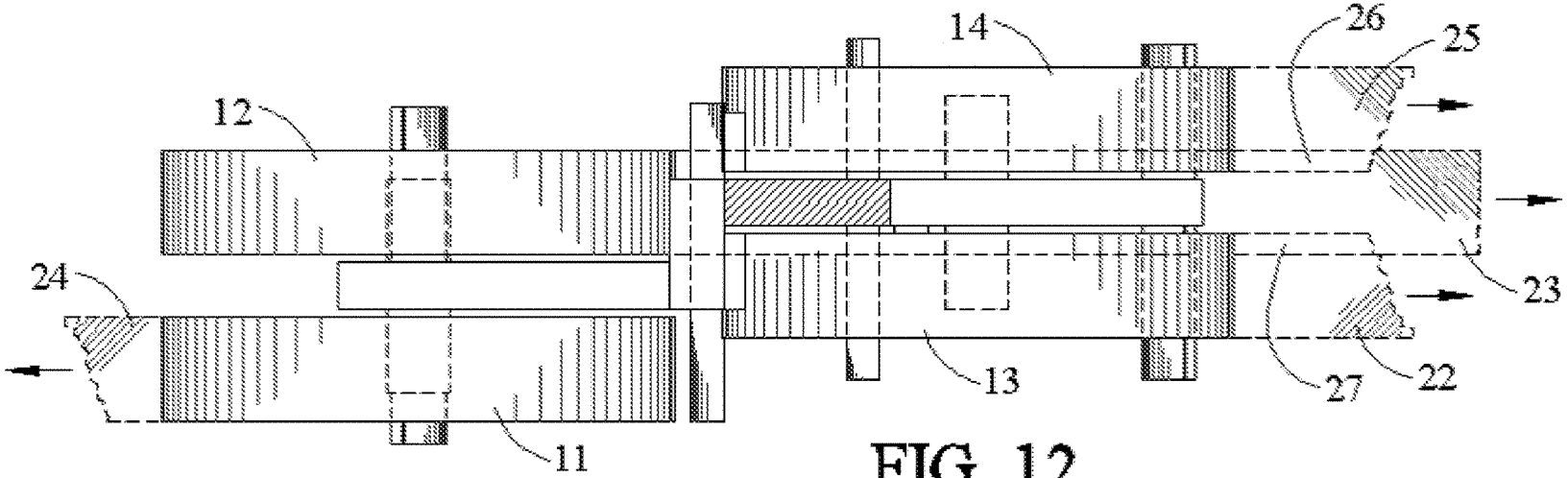

FIG. 12 is a top view of the multi-tape dispenser (without showing the handle) showing four tape rolls mounted. Each tape roll is mounted onto each side of each wall panel. Three tape rolls would form reversed-conjoined tape end portions dispensing toward the front and one tape roll dispensing rearward without being conjoined.

Figure 13:
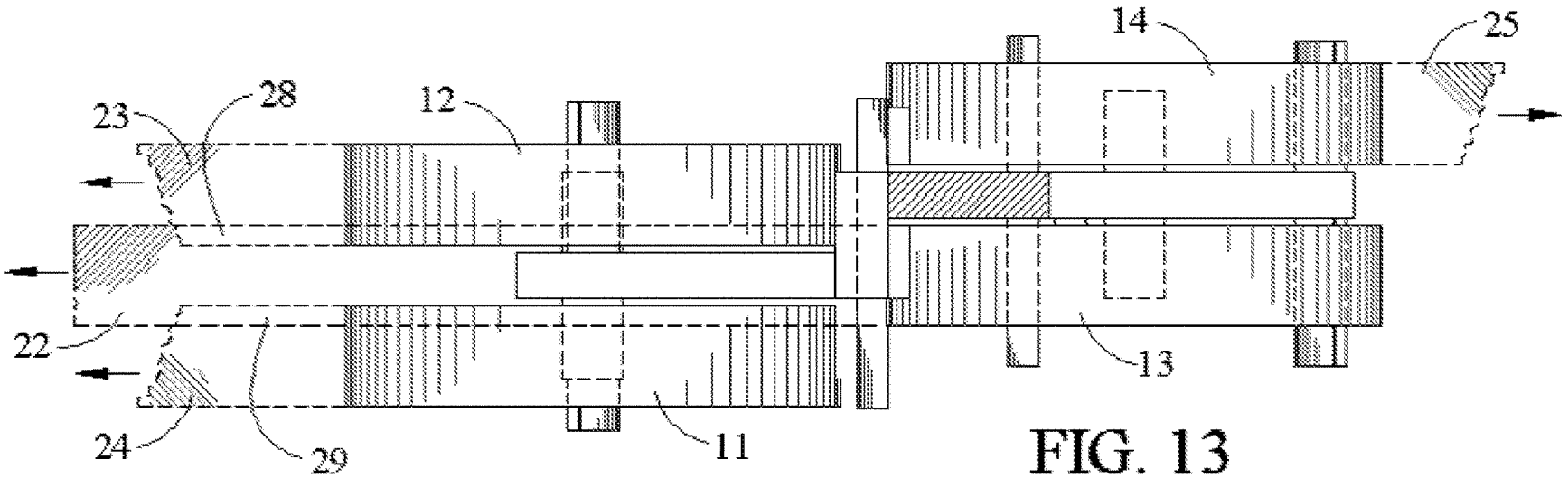

FIG. 13 is a top view of the multi-tape dispenser (without showing the handle) showing four tape rolls mounted. Each tape roll is mounted onto each side of each wall panel. Three tape rolls would form reversed-conjoined tape end portions dispensing rearward and one tape roll dispensing toward the front.

Figure 14:
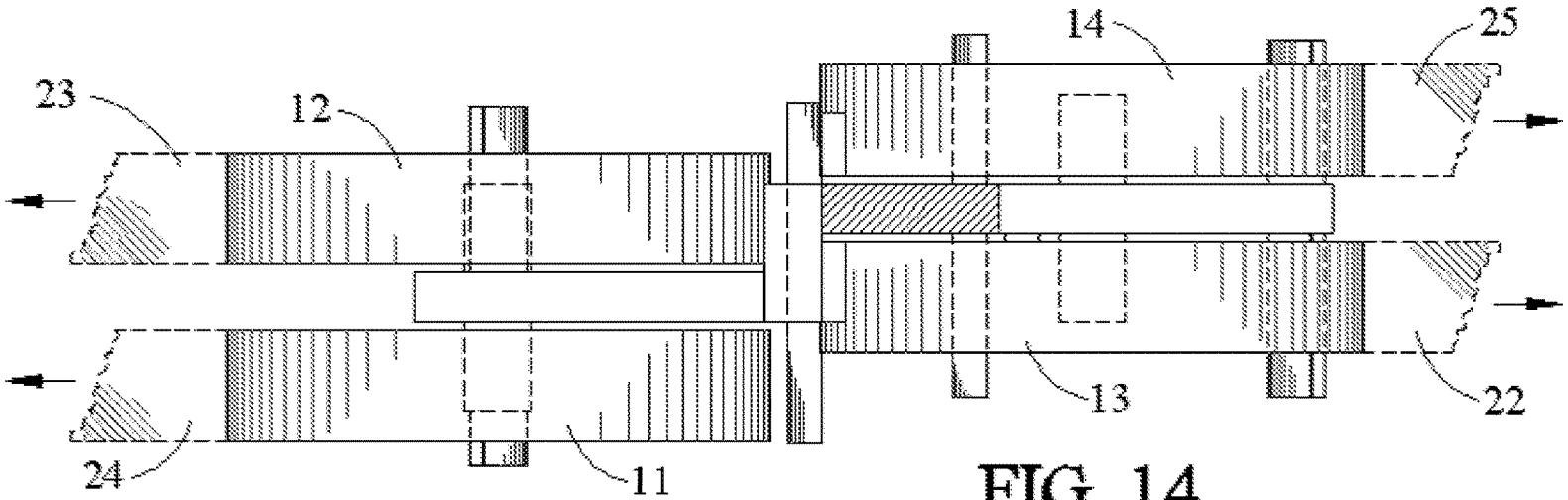

FIG. 14 is a top view of the multi-tape dispenser (without showing the handle) showing four tape rolls mounted. Each tape roll is mounted onto each side of each wall panel. Each tape roll is dispensed independently without being conjoined.

Figure 15:
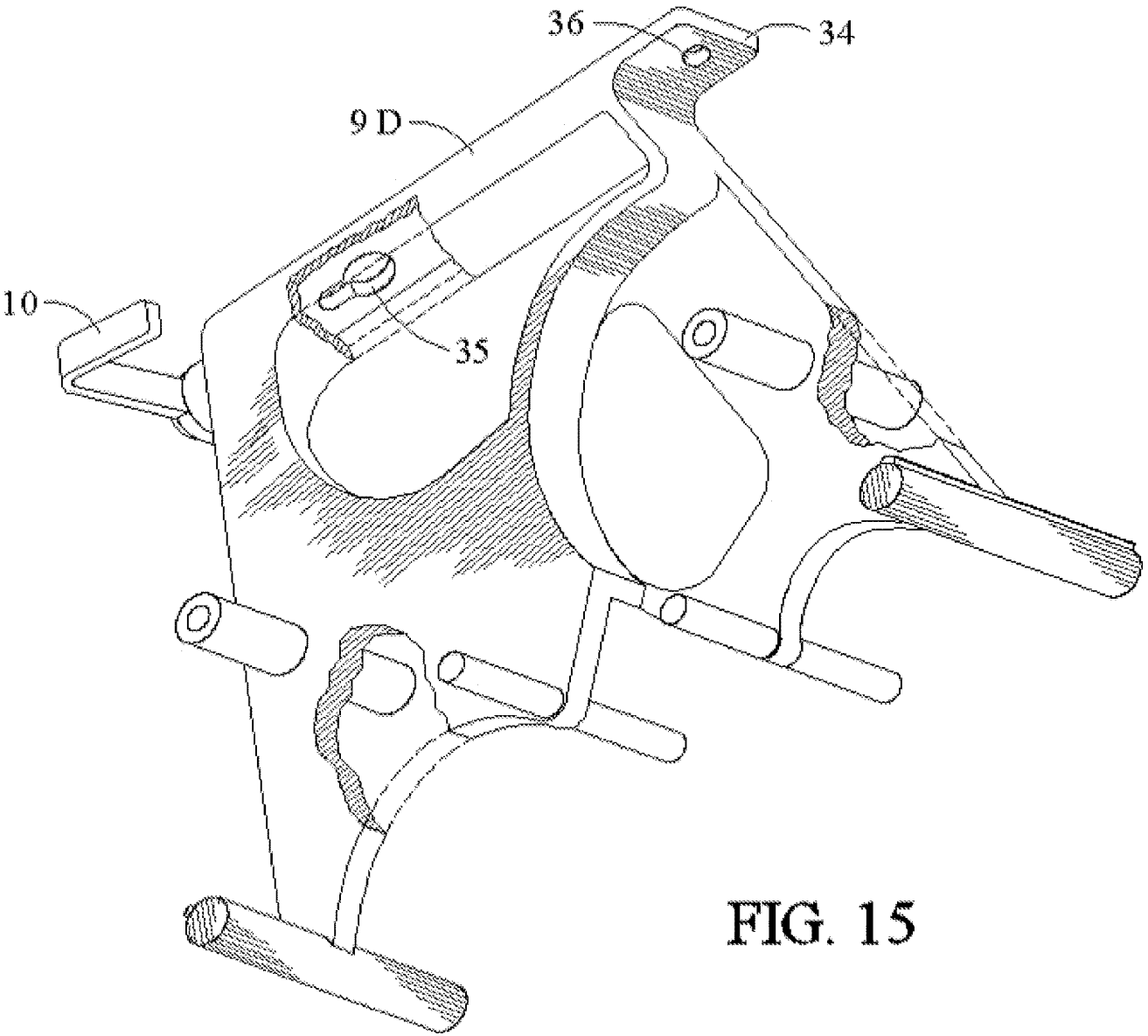

FIG. 15 is a dimetric view of the multi-tape dispenser showing the handle with an addon thumb rest, at least one keyhole and at least one screw hole so that the multi-tape dispenser can be installed onto a wall or workshop table.

Figure 16:
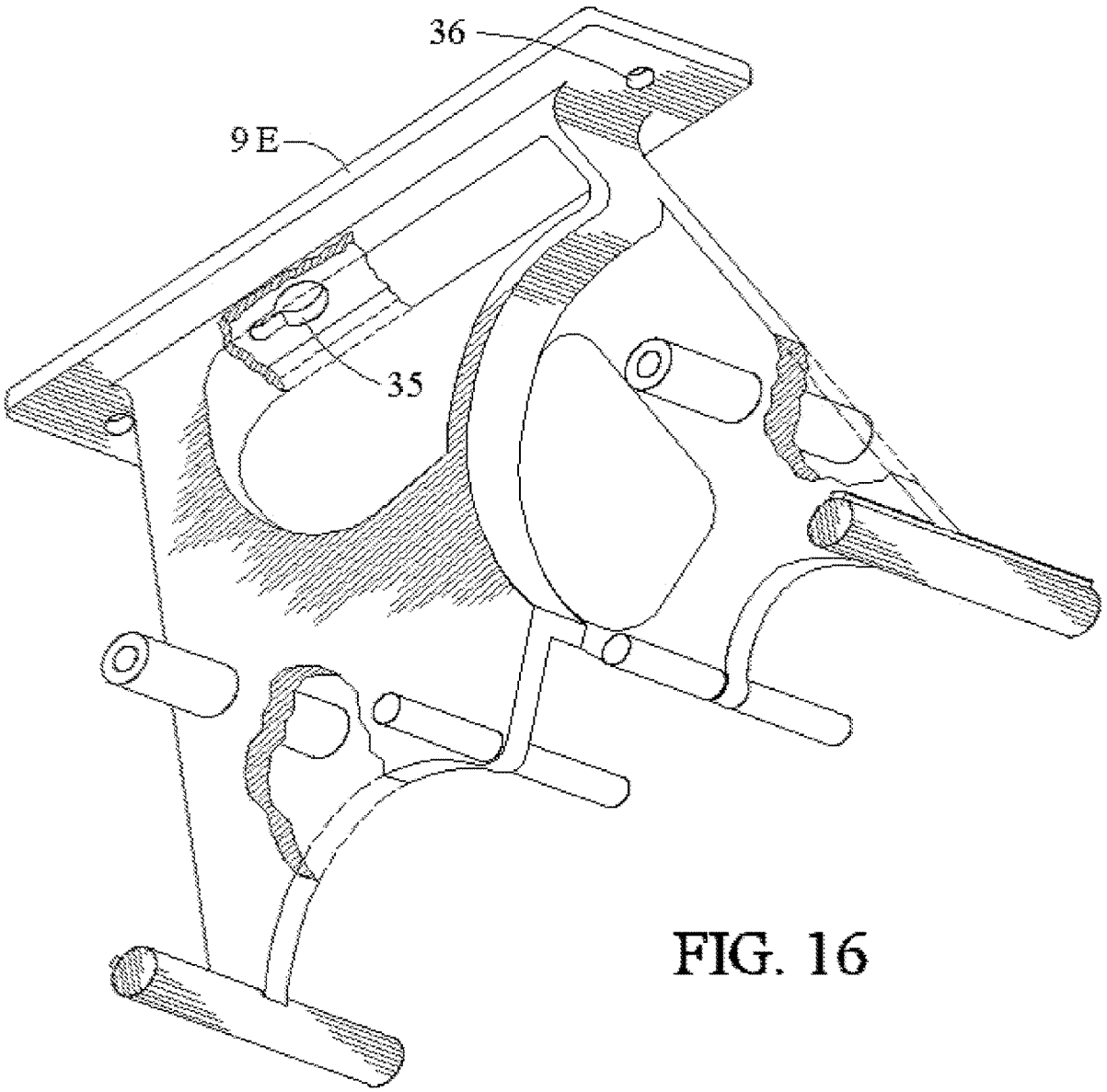

FIG. 16 is a dimetric view as seen from a front-right angle below the multi-tape dispenser showing the base structure as part of the handle; said base structure is wider and longer to provide a broader base that can be placed onto a table top with or without being fastened to a surface.

Figure 17:
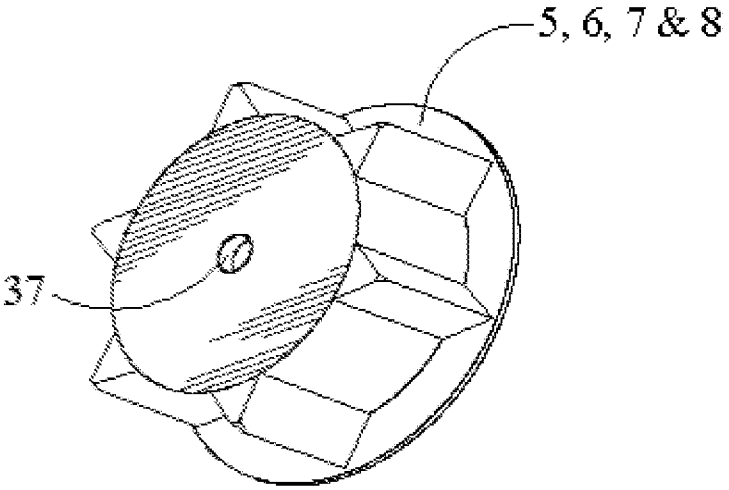

FIG. 17 is a dimetric view of the tape roll hub as viewed from the outside.

Figure 18:
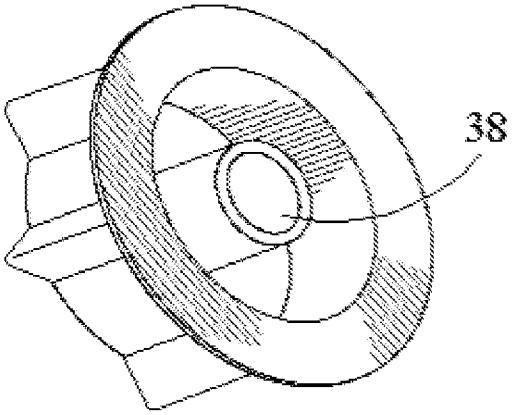

FIG. 18 is a dimetric view of the tape roll hub as viewed from the inside.

DETAILED DESCRIPTION OF THE DRAWINGS

Figure 1:
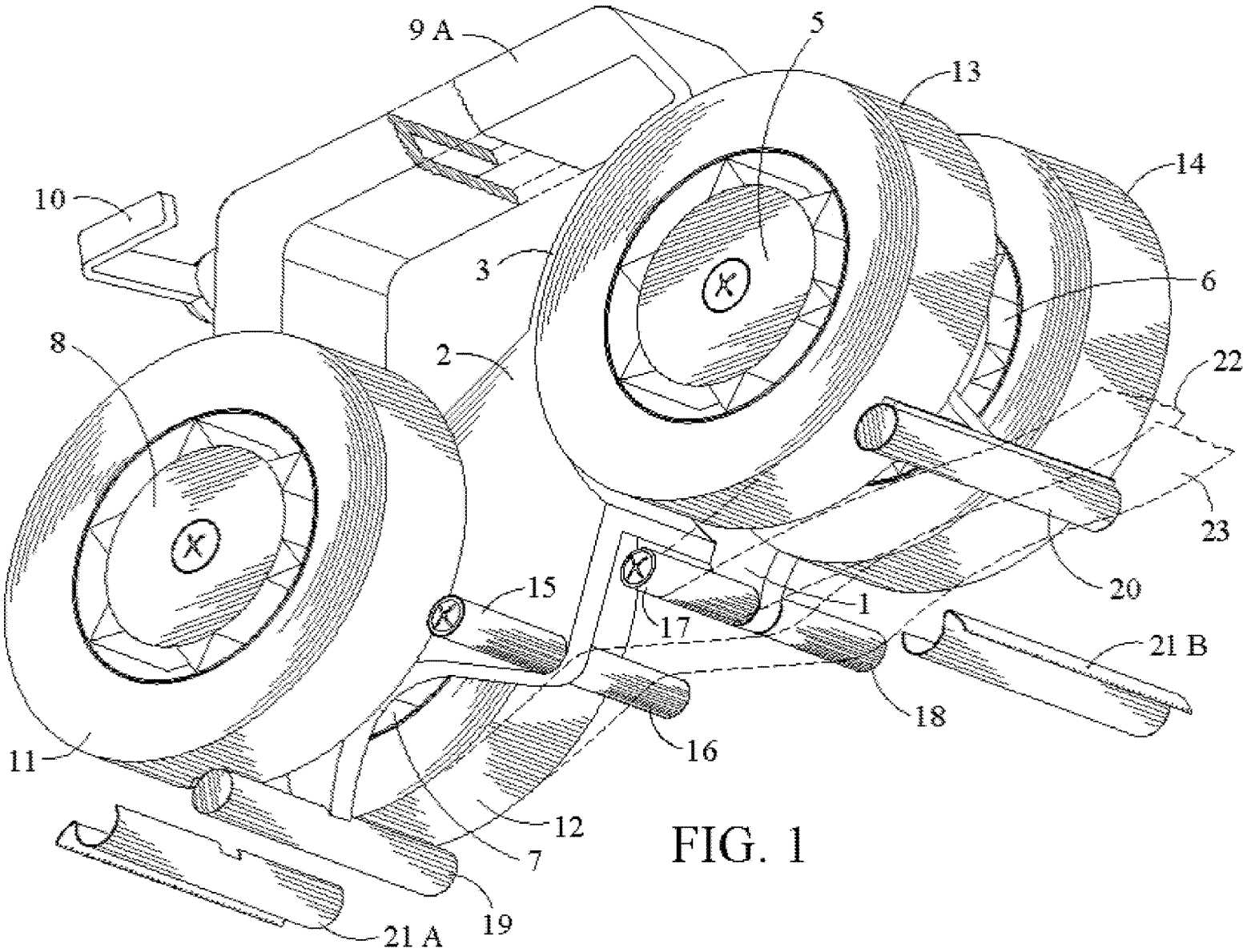
FIG. 1 is a dimetric view of the multi-tape dispenser having 4 tape rolls mounted for dispensing reversed-conjoined and/or non-reversed-conjoined tape end strips.

FIG. 1 is a dimetric view as seen from a front-right angle below the multi-tape dispenser in accordance with the present invention in which the housing structure having a first wall panel (1), a second wall panel (2) and a third wall panel (3); said first wall panel (1) is offset from the second wall panel (2), and having surfaces in different planes however having surfaces being paralleled with one another; said third wall panel (3) having a radius generating from the center of the hollow cylinder (32) positioned near the middle of the first wall panel (1); said third wall panel (3) having an inside radius configured to be larger than the radius of a standard tape roll intended for use; said third wall panel (3) is substantially perpendicular to the first wall panel (1) and the second wall panel (2); said third wall panel (3) is connected to the first wall panel (1) at the upper end and lower end portion on one side edge of the third wall panel (3) and partially connected to the second wall panel (2) on the other side edge of the third wall panel (3); said first wall panel (1) is configured so that the upper end of the first wall panel (1) is connected to the front of the handle (9A); said second wall panel (2) is configured so that the upper end of the second wall panel (2) is connected to the rear of the handle (9A) where the pivotable L-shaped hook (10) is attached to; the bottom front portion of the first wall panel (1) and the bottom rear portion of the second wall panel (2) having at least one cylindrical tape-cutting-blade receptacle (19 and/or 20) incorporated perpendicularly to the first wall panel (1) and/or second wall panel (2), and the bottom rear portion of the first wall panel (1) having at least one front cylindrical tape cantilever (17 and/or 18) projected outwardly and perpendicularly from the first wall panel (1); said upper end of the third wall panel (3) is connected to the upper portion of the first wall panel (1) which is positioned under the handle (9A); said third wall panel (3) is also connected to the first wall panel (1) near the bottom rear portion of the first wall panel (1) and just above the front cylindrical tape cantilever (17 & 18) where the front and rear tape end portions (22 & 23) become reversed-conjoined partially while being rolled by the front cylindrical tape cantilevers (17 & 18) along the dispensing path; said second wall panel (2) is connected to the lower side edge portion of the third wall panel (3), and extended toward the rear end of the multi-tape dispenser where at least one rear tape-roll hub (land/or 8) is rotatably attached for at least one rear tape roll (11 and/or 12) to be mounted thereto; said second wall panel (2) having at least one rear cylindrical tape cantilever (15 and/or 16) projected outwardly and perpendicularly from the bottom front of the second wall panel (2) where at least one rear tape roll (11 and/or 12) rolls by on top surface of the rear cylindrical tape cantilever (15 and/or 16) and move onto the underside of the front cylindrical cantilever (17 and/or 18) where dispensed tape end portions (22 & 23) become reversed-conjoined before cutting into tape strips; the tapecutting blades (21 A & 21 B) are shown separating from the cylindrical tape-cutting-blade receptacles (19 & 20), however they can be permanently affixed thereto, or can be fabricated as part of the cylindrical tape-cutting-blade receptacle (19 & 20); a front tape roll (13) installed onto front tape roll hub (5) is on the recessed side of the first wall panel (1) for dispensing tape strip (22), and a rear tape roll (12) installed onto rear tape roll hub (7) is on the recessed side of the second wall panel (2) for dispensing tape strip (23); another front tape roll (14) installed onto front tape roll hub (6) is positioned on the protruding side of the first wall panel (1), and another rear tape roll (11) installed onto rear tape roll hub (8) is positioned on the protruding side of the second wall panel (2); the thirst wall panel (3) is connected to the first wall panel (1) and second wall panel (2); a handle (9A) is incorporated as part of the housing structure; said handle having a pivotable L-shaped hook (10) installed; the tape cylindrical cantilevers (15, 16, 17 & 18) are incorporated as shown, rolling sleeves (not shown) may be utilized to help dispensing tape portions from sticking to the tape cylindrical cantilevers (15, 16, 17 & 18); the tape cutting blade (21 B) installing on the front cylindrical tape-cutting-blade receptacle (20) is connected to the bottom of the first wall panel (1) and another tapecutting blade (21 A) installing on the cylindrical tape-cutting-blade receptacle (19) is connected to the bottom rear end of the second wall panel (2); said housing structure having hardware for fastening parts onto the housing structure, consisting: at least two bolts, nuts, washers, springs and/or rivets; and/or including washers, spring washers, springs and/or wing nuts.

The handle having an L-shaped hook which is attached to the rear portion of the handle and pivotable around the axis of the handle while having some friction to keep the L-shaped hook from pivoting freely; said L-shaped hook having first end portion with a circular ring-like end, extending portion, and hook end portion in all of which having the same wall thickness; said circular ring-like end of a first end portion having a hole for a rivet or a bolt to be fastened through with a spring washer or a rubber washer included in order for the L-shaped hook to be pivotably fastened to the rear end of the handle frame; the extending portion of the L-shaped hook is extended outwardly perpendicular to the axis of the handle frame, and hook end is bent generally toward the front end of the handle frame so that it becomes an L-shaped hook where it can be hooked onto, such as, the user's belt, belt loop, pants' side pocket or ladder.

The housing structure having a first wall panel which has at least one hollow cylinder incorporated near the middle of the first wall panel and extended outwardly and perpendicularly on at least one side of the first wall panel where at least one tape roll hub is rotatably installed thereto, and the second wall panel also has at least one hollow cylinder incorporated near the middle rear portion of the second wall panel and extended outwardly and perpendicularly on at least one side of the second wall panel where at least one rear tape-roll hub is rotatably installed thereto; said each hollow cylinder is configured so that it would be the center of the tape-roll hub and therefore center of the tape roll; said hollow cylindrical tape cantilever on each side of the wall panel having hollow-through hole so that a rivet can be used to fasten both tape-roll hubs onto each wall panel; said hollow cylinder can be incorporated on one side of the first wall panel when the multi-tape dispenser is manufactured for one tape-roll hub to be installed on the first wall panel; said hollow cylinder can be incorporated on one side of the second wall panel The tape-roll hubs are circularly formed with plurality of ridges intended as points of contact to fit into a bore opening of a standard tape roll; said ridges incorporated onto the outer curved surface of the tape-roll hub to be radially paralleled with the axis of the hollowed cylinder on the inside of the tape-roll hub, and therefore radially paralleled with the axis of the hollow cylinder on the first wall panel and similarly for hollow cylinder on the second wall panel; said tape-roll hub having a bolt hole for a bolt and washer or washers and rivet fastened in order to hold at least one tape-roll hub onto the first wall panel and also to hold at least one tape-roll hub onto the second wall panel; said hollow cylinder on the inside of the tape-roll hub can rotatably fit onto the hollow cylinder on the wall panel; said tape-roll hub having substantially similar size and shape as for the front and rear tape-roll hubs.

The multi-tape dispenser having at least one front tape roll which is mounted onto the first wall panel and at least one rear tape roll which is mounted onto the second wall panel where the front tape roll and rear tape roll are arranged to rotate in opposite direction; said front tape roll is positioned to roll in forward direction when the tape end portion is being pulled, and therefore, the rear tape roll would roll in rearward direction; said at least one front and/or rear tape roll can be installed to be dispensed without being conjoined; said first wall panel may comprise at least one front tape-roll hub to be rotatably fastened to the hollow cylinder on the first wall panel by a set of spring washers and bolt or rivet; said tape-roll hub to be manufactured to have a hollow cylinder extending through the axis of the tape roll-hub so that a rivet can be fastened through the first wall panel and through at least one tape-roll hub; a bolt with spring washers can be used with a wing nut in place of a rivet so that the user may manually adjust the friction applied onto the tape-roll hub by turning the wing nut; said second wall panel comprises at least one rear tape-roll hub to be rotatably fastened to the hollow cylinder on the second wall panel by a set of spring washers and rivet; said tape-roll hub to be manufactured to have a hollow cylinder extending through the axis of the tape roll-hub and properly fit onto the hollow cylinder on the second wall panel so that a rivet can be fastened through the second wall panel and through at least one tape-roll hub; a bolt with spring washers can be used with a wing nut in place of a rivet so that the user may manually adjust the friction applied onto the tape-roll hub by turning the wing nut.

The multi-tape dispenser having at least two tape-roll hubs configured on the housing structure, said housing structure having one front tape-roll hub positioned on the recessed side of the first wall panel, one rear tape-roll hub positioned on the recessed side of the second wall panel, and a rear tape-roll hub positioned on the protruding side of the second wall panel; said rear tape-roll hubs are rotatably installed onto the hollow cylinder on at least one side of the second wall panel having the same axis and rotatably fastened by a rivet or a bolt, at least one spring washer, and a wing nut; said rear tape-roll hubs are arranged so that each rear tape roll mounted on each tape-roll hub having an overlapped edge to be reversed-conjoined with an adjacent edge of the front tape roll on the first wall panel.

The multi-tape dispenser having at least two tape-roll hubs configured on the housing structure, said housing structure having one front tape-roll hub positioned on the recessed side of the first wall panel, one rear tape-roll hub positioned on the recessed side of the second wall panel, and a front tape-roll hub positioned on the protruding side of the first wall panel; said front tape-roll hubs are rotatably installed onto the hollow cylinder on at least one side of the first wall panel having the same axis and rotatably fastened by a rivet, or a bolt, at least one spring washer, and a wing nut; said front tape-roll hubs are arranged so that each front tape roll mounted on each tape-roll hub having an overlapped edge being reversed-conjoined with an adjacent edge of the rear tape roll on the second wall panel.

The handle is an elongated frame extending in a longitudinal direction generally toward the rear end of the housing structure and is connected to the upper portion of the first wall panel and upper portion of the second wall panel; said handle is positioned substantially above the tape rolls mounted onto the front and rear tape-roll hubs so that the user's hand can hold the handle without touching the front or rear tape roll; said handle may include at least one key hole and at least one screw hole so that the multi-tape dispenser can be installed by screws or nails onto such a wall surface; said handle may have a thumb rest; said handle is fabricated with wall ridges longitudinally to increase rigidity and improve handle control; a handle tubing may be utilized to cover said handle; said handle includes an L-shaped hook.

Figure 2:
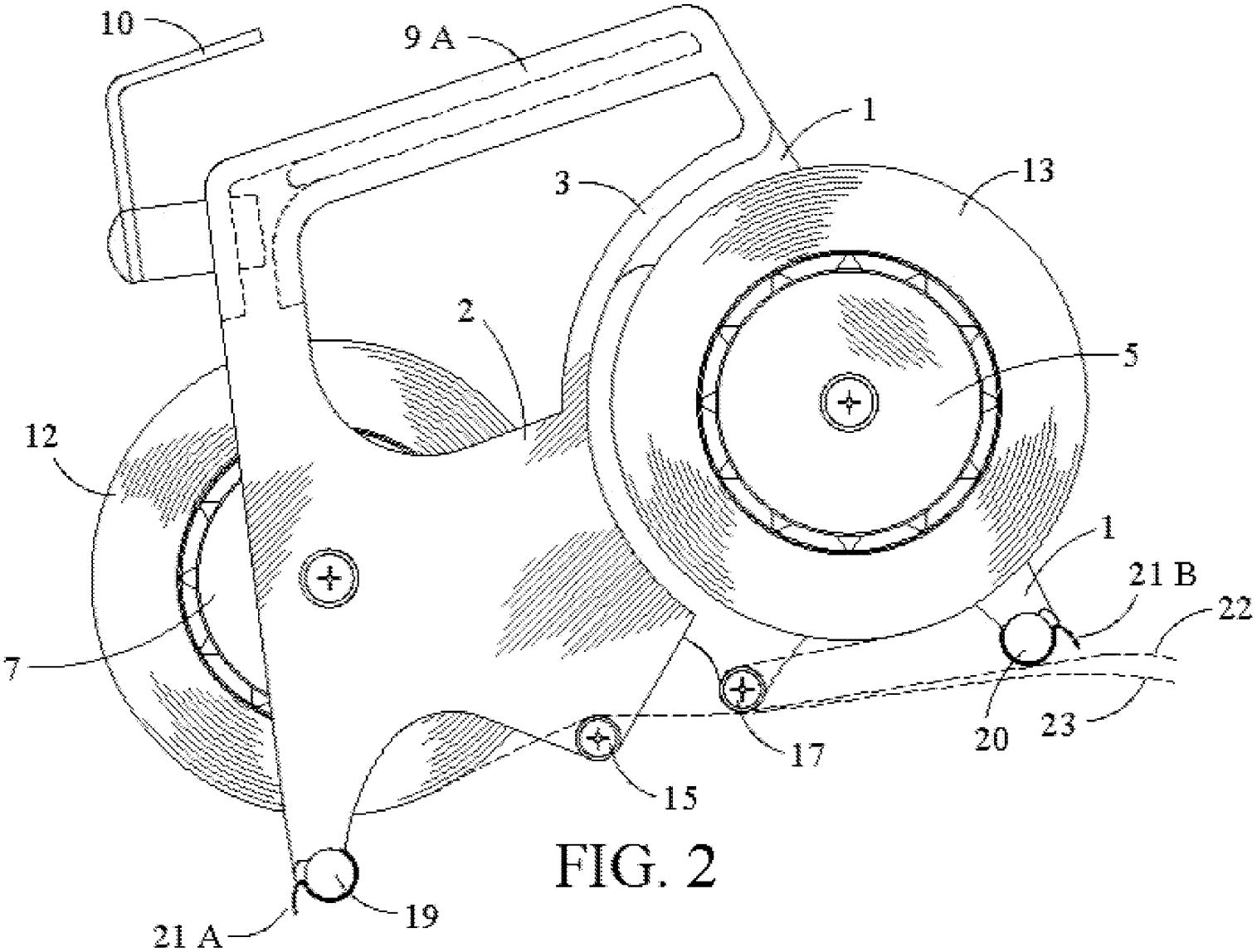
FIG. 2 is a right side view of the multi-tape dispenser showing two tape rolls mounted on the recessed side of each wall panel.

FIG. 2 is a right side view showing a front tape roll (13) installed onto tape roll hub (5) positioned on the first wall panel (1) which is in the front portion of the multi-tape dispenser as seen from the right side of the device, and a rear tape roll (12) installed onto tape roll hub (7) which is positioned on the recessed side of the second wall panel (2) and is on the back portion of the multi-tape dispenser in all of which to be positioned under the handle (9A); an L-shaped hook (10) is rotatably attached to the rear end of the handle (9A). A tape roll hub (8) and tape roll (11) are optional and not shown on second wall panel (2). The lower portion of the third wall panel (3) is connected to the second wall panel (2). The rear tape-cutting blade (21 A) is snapped onto the rear cylindrical tape-cutting-blade receptacle (19) and the front tape-cutting blade (21 B) is snapped onto the front cylindrical tape-cutting-blade receptacle (20); The cylindrical tape cantilever (15 & 17) are shown showing how the tape end portions are being dispensed. The cylindrical tape cantilevers (16 & 18), not shown, are positioned on the other side of the wall panels (1 & 2); therefore they are not visible on FIG. 2. The tape end portion (22) dispensing from tape roll (13) and tape end portion (23) dispensing from tape roll (12) are illustrated showing how they become reversed-conjoined. Please refer to FIG. 1 for additional items numbered or not shown on FIG. 2.

Figure 3:
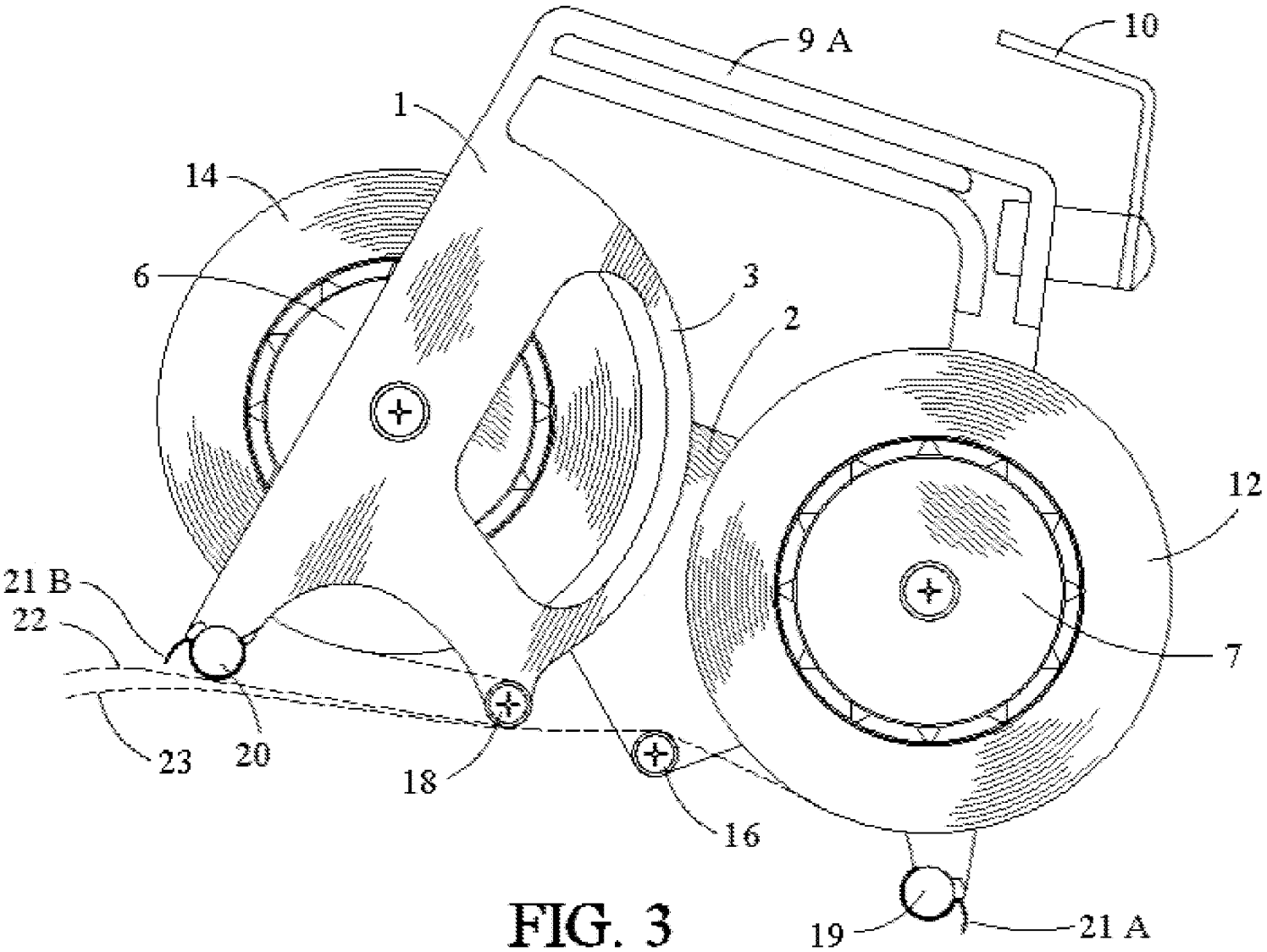
FIG. 3 is a left side view of the multi-tape dispenser showing two tape rolls mounted on the recessed side of each wall panel.

FIG. 3 is a left side view showing the first wall panel (1) and third wall panel (3) connected to the handle (9A) at the upper portion of the first wall panel (1) and upper portion of the third wall panel (3); said handle (9A) having an L-shaped hook (10) rotatably attached to the rear end of the handle (9A); the second wall panel (2) is connected to the other edge of the third wall panel (3). A tape roll hub (6) and tape roll (14) are shown on the recessed side of the first wall panel (1). Tape-roll hub (5) and tape roll (13) are optional and not shown on the protruding side of the first wall panel (1). Tape-roll hub (7) and tape roll (12) are shown on the recessed side of the second wall panel, and tape-roll hub (8) and tape roll (11) are optional and not shown on the protruding side of the second wall panel (2). The tape-cutting blade (21 B) is snapped onto the cylindrical tape-cutting-blade receptacle (20) and the tape-cutting blade (21 A) is snapped onto the cylindrical tape-cutting-blade receptacle (19). The tape cylindrical cantilever (18 & 16) are shown having the tape end portions being dispensed; the tape cylindrical cantilever (15 & 17) are position on the other side of the wall panel; therefore they are not visible on FIG. 3. The tape end portion (22) is dispensed from tape roll (14) and the tape end portion (23) is dispensed from tape roll (12). Please refer to FIG. 1 for additional items numbered or not shown on FIG. 3.

Figure 4:
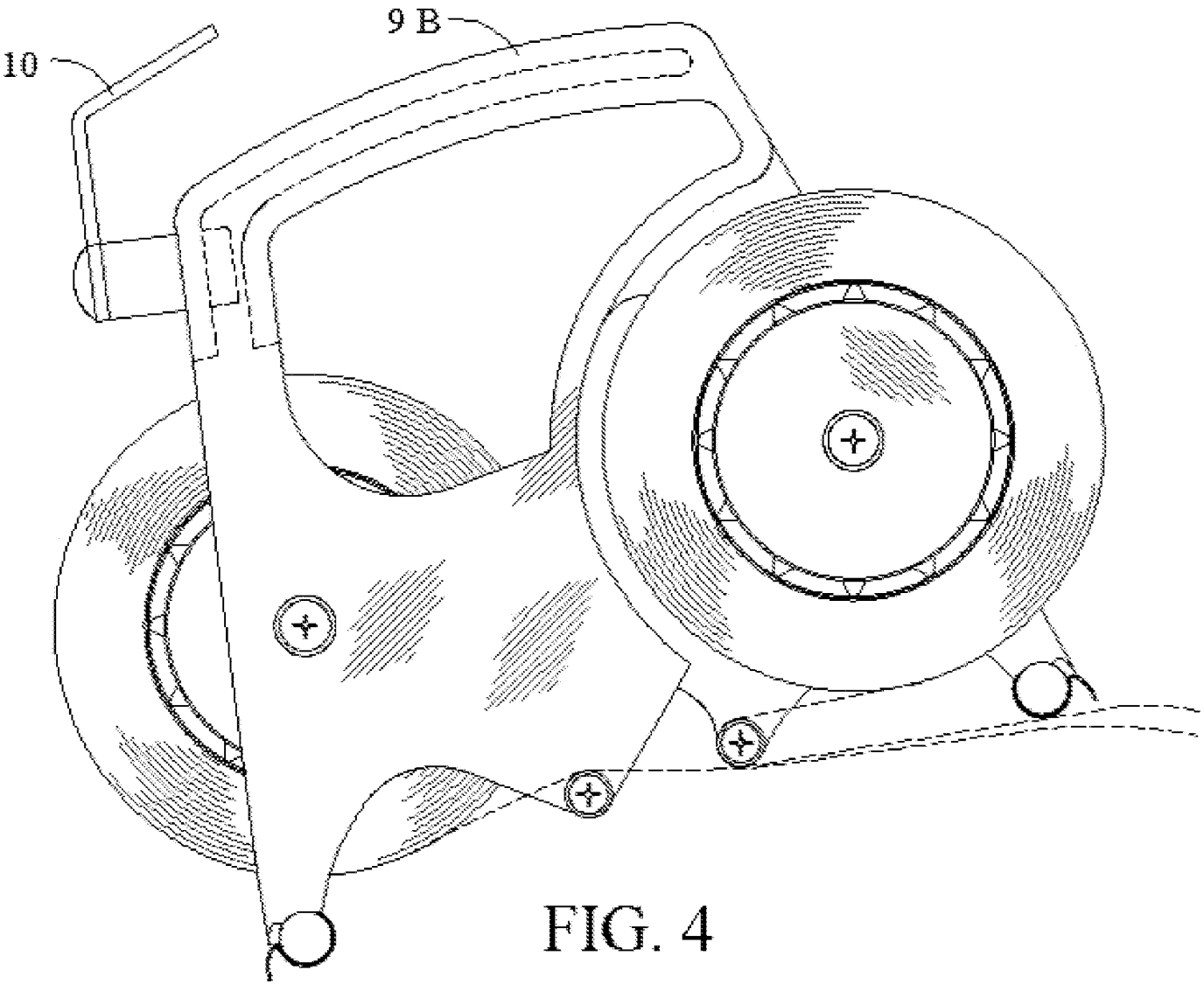
FIG. 4 is a right side view of the multi-tape dispenser showing the curved handle with a rotatable L-shaped hook.

FIG. 4 is a right side view of the multi-tape dispenser showing an optional handle (9B) slightly curved; said handle (9B) having an L-shaped hook (10) rotatably attached to the rear end of the handle (9B).

Figure 5:
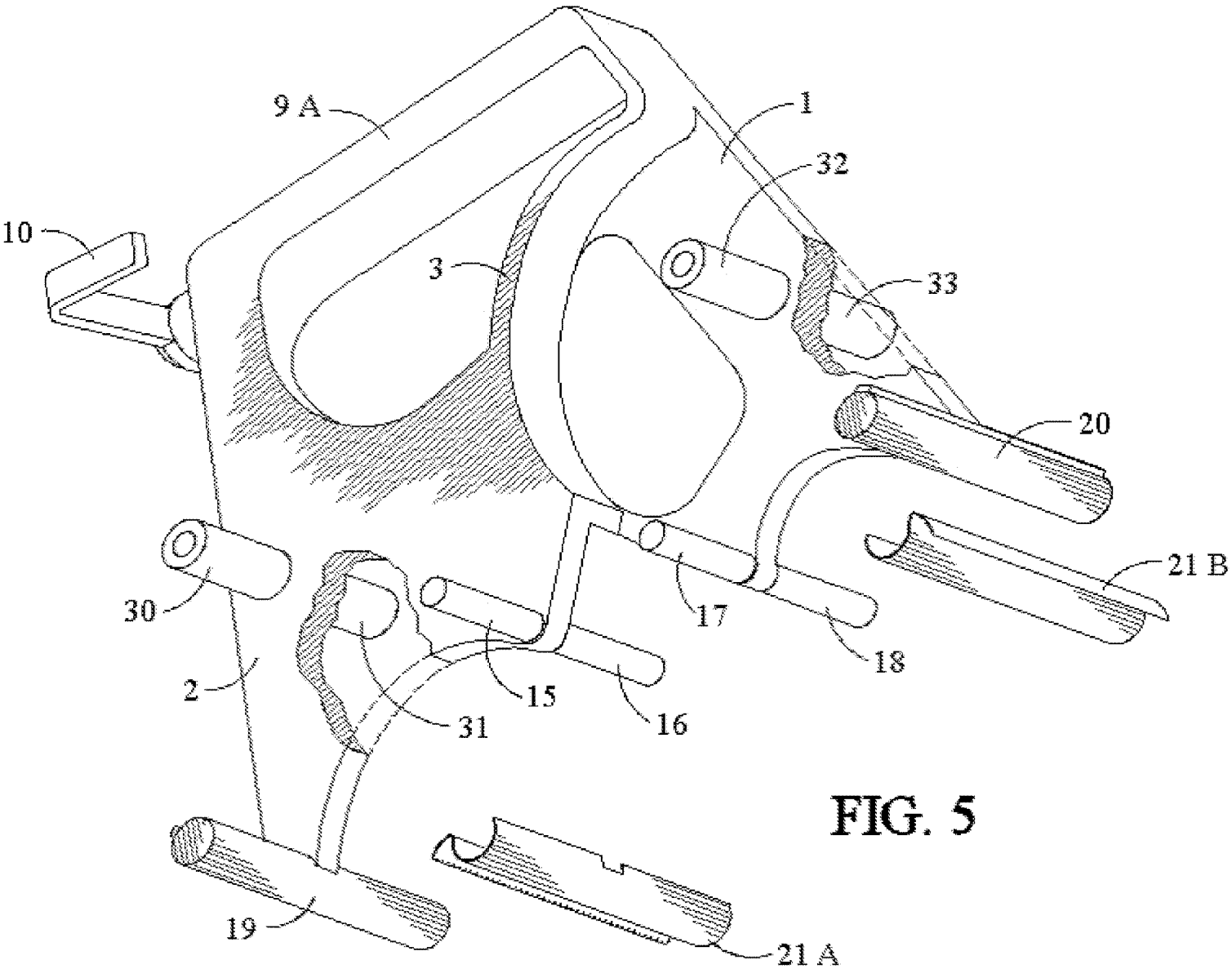
FIG. 5 is a dimetric view of the multi-tape dispenser showing the housing structure including the handle and L-shaped hook, hollow cylinders, cylindrical tape cantilevers, cylindrical tape-cutting-blade receptacles and tape-cutting blades.

FIG. 5 is a dimetric view as seen from the front-right angle below the multi-tape dispenser. The L-shaped hook (10) is rotatably attached to the rear end of the handle (9A), the front portion of the handle (9A) is connected to the upper portion of the first wall panel (1) and third wall panel (3); said first wall panel (1) having hollow cylinders (32 & 33) attached near the center of the first wall panel (1). The cutting blade receptacle (20) is attached to the bottom front portion of the first wall panel (1) where the tape-cutting blade (21 B) can be snapped onto the cylindrical tape-cutting-blade receptacle (20). The cylindrical tape cantilevers (17 & 18) are incorporated to the back bottom portion of the first wall panel (1) and may include rotatable non-stick rolling sleeves (not shown) installed thereto. The rear end of the handle (9A) is connected to the upper portion of the second wall panel (2); said second wall panel (2) having hollow cylinder (30 & 31) incorporated near the middle back portion where the tape-roll hubs would be installed onto; said second wall panel (2) having cylindrical tape cantilevers (15 & 16) incorporated at the bottom front of the second wall panel (2) and may include rotatable non-stick rolling sleeves (not shown) installed thereto; a cylindrical tapecutting-blade receptacle (19) is attached to the bottom rear portion of the second wall panel (2) where the tape-cutting blade (21 A) can be snapped onto. All four hollow cylinders (30, 31, 32 & 33) are incorporated as part of this multi-tape dispenser housing structure.

Figure 6:
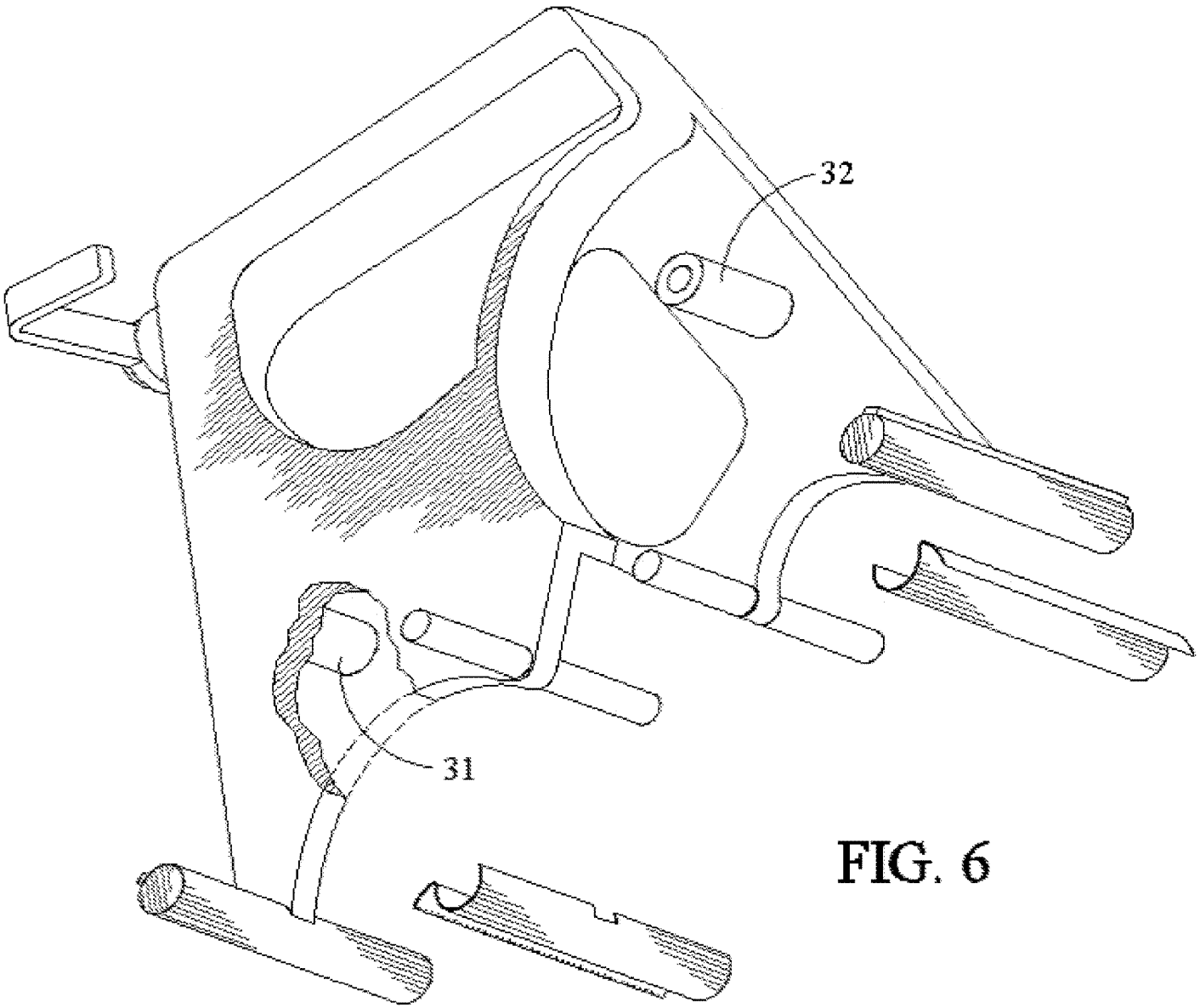

FIG. 6 is a dimetric view as seen from the front-right angle below the multi-tape dispenser which shows the position of the hollow cylinder (31) and hollow cylinder (32) as an option for the multi-tape dispenser having only two tape rolls.

FIG. 7 is a dimetric view as seen from a front-right angle below the multi-tape dispenser showing the handle (9C) in an elongated cylindrical shape with an L-shaped hook (10) installed to the back end of the handle (9C).

FIG. 8 is a right side view of the tape dispenser showing the handle (9C) in an elongated cylindrical shape having a rotatable L-shaped hook installed to the back end of the handle (9C). The housing structure shows a front tape roll (13) is installed onto the rotatable tape-roll hub (5) positioned on the first wall panel (1) which is in the front portion of the multi-tape dispenser as seen from the right side of the device, and a rear tape roll (12) installed onto the rotatable tape-roll hub (7) which is positioned on the recessed side of the second wall panel (2) and is on the back portion of the multi-tape dispenser in all of which to be positioned under the handle (9C). A rotatable tape-roll hub (8) and tape roll (11) are optional and not shown on second wall panel (2). The lower portion of the third wall panel (3) is connected to the second wall panel (2). The rear tape-cutting blade (21 A) is snapped onto the rear cylindrical tape-cutting-blade receptacle (19) and the front tape-cutting blade (21 B) is snapped onto the front cylindrical tape-cutting-blade receptacle (20); The cylindrical tape cantilevers (15 & 17) are showing how the tape end portions are being dispensed. The cylindrical tape cantilevers (16 & 18), not shown, are positioned on the other side of the wall panels (1 & 2); therefore they are not visible on FIG. 8. The tape end portion (22) dispensing from tape roll (13) and tape end portion (23) dispensing from tape roll (12) are illustrated showing how they become reversed-conjoined. Please refer to FIG. 1 for additional items numbered or not shown on FIG. 8.

FIG. 9 is a dimetric view as seen from a front-right angle below the multi-tape dispenser showing the handle (9C) in an elongated cylindrical shape having a rotatable L-shaped hook installed to the back end of the handle (9C). The housing structure shows parts as shown on FIG. 8 without the tape-roll hubs (5 & 7) and tape rolls (12 & 13). The housing structure also shows the hollow cylinders (30, 31, 32 & 33), cylindrical tape cantilevers (15, 16, 17 & 18), cylindrical tape-cutting-blade receptacles (19 & 20) and tape-cutting blades (21 A & 21 B).

FIG. 10 is a di metric view as seen from a front-right angle below the multi-tape dispenser showing a hollow cylinder (31) on the recessed side of the second wall panel and a hollow cylinder (32) on the recessed side of the first wall panel. FIG. 10 indicates the multi-tape dispenser is for dispensing 2 tape rolls. If both tape rolls are dispensed in the forward direction, they can be arranged to be reversed-conjoined. If the front tape roll is dispensed in forward direction and the rear tape roll is dispensed in the rearward direction, then they are not conjoined. FIG. 11 is a top view of the multi-tape dispenser (without showing the handle) showing the tapes in relation to positions and dispensing path. The tape roll (12) dispensing tape end portion (23) and tape roll (13) dispensing tape end portion (22) toward the front (left side of the illustration) form a reversed-conjoined overlap (26). The tape roll (11) dispensing tape end portion (24) toward the rear (right side of the illustration) provides tape end portion (24) without being conjoined. The arrows indicate the directions of each tape end portion being dispensed.

FIG. 12 is a top view of the multi-tape dispenser (without showing the handle) showing the tapes in relation to positions and dispensing path. The tape roll (14) dispensing tape end portion (25), the tape roll (13) dispensing tape end portion (22) and the tape roll (12) dispensing tape end portion (23) together toward the front (left side of the illustration) form reversed-conjoined overlaps (26 & 27). The tape roll (11) dispensing tape end portion (24) toward the rear (right side of the illustration) provides tape end portion (24) without being conjoined. The arrows indicate the directions of each tape end portion being dispensed.

FIG. 13 is a top view of the multi-tape dispenser (without showing the handle) showing the tapes in relation to positions and dispensing path. The tape roll (11) dispensing tape end portion (24), the tape roll (12) dispensing tape end portion (23) and the tape roll (13) dispensing tape end portion (22) together toward the rear (right side of the illustration) form reversed-conjoined overlaps (28 & 29). The tape roll (14) dispensing tape end portion (25) toward the front (right side of the illustration) provides tape end portion (25) without being conjoined. The arrows indicate the directions of each tape end portion being dispensed.

FIG. 14 is a top view of the multi-tape dispenser (without showing the handle) showing the tapes in relation to positions and dispensing path. The tape roll (14) dispensing tape end portion (25) and the tape roll (13) dispensing tape end portion (22) toward the front (right side of the illustration) provide tape end portions being dispensed separately without being conjoined. The tape roll (12) dispensing tape end portion (23) and the tape roll (11) dispensing tape end portion (24) toward the rear (left side of the illustration) provide tape end portions being dispensed separately without being conjoined. The arrows indicate the directions of each tape end portion being dispensed.

FIG. 15 is a dimetric view as seen from a front-right angle below the multi-tape dispenser showing the handle (9 D) with an add-on thumb rest (34), at least one keyhole (35) and at least one screw hole (36) so that the multi-tape dispenser can be installed onto a wall or workshop table.

FIG. 16 is a dimetric view as seen from a front-right angle below the multi-tape dispenser showing the base structure (9 E) in place of the handle (9 D) shown on FIG. 15; the rotatable L-shape hook is not needed when the base structure (9E) is utilized; said base structure (9 E) is wider and longer to provide a broader base that can be placed onto a table top with or without being fastened to a surface.

FIG. 17 is a dimetric view of the tape roll hub (5, 6, 7 & 8) as viewed from outside. The hole (37) is for hardware such as a rivet fastened to hold the tape roll hub to the hollow cylinder on the wall panel.

FIG. 18 is a dimetric view of the tape roll hub as viewed from inside where an internal hollow cylinder (38) is visible as part of the tape roll hub (5, 6, 7 & 8); said internal hollow cylinder would fit over the hollow cylinder configured on the wall panel.

Those skilled in the art will observe that the multi-tape dispenser for dispensing reversed-conjoined and/or non-reversed-conjoined tape strips is manufactured for use in construction, remodeling industry, manufacturers, schools and by general end consumers. The multi-tape dispenser is manufactured to utilize tape rolls with standard tape bore openings, and described in connection with FIG. 1-18 of the drawings hereinbefore can be modified to house and dispense at least two rolls of tapes and up to four tape rolls mounted simultaneously which means tape roll hubs (5 & 6) can be positioned on each side of the first wall panel (1) and tape roll hubs (7 & 8) can be positioned on each side of the second wall panel (2). The maximum number of tape rolls can be used as to attain reversed-conjoined tape strips on the multi-tape dispenser are three tape rolls and/or at least one tape roll can be dispensed without being reversed-conjoined.

Although but one basic embodiment and a few modifications of the present invention has been illustrated and described, it will be apparent to those skilled in the art that various changes and modifications may be made therein without departing from the spirit of the invention.

What is claimed is:

1. A multi-tape dispenser for dispensing reversed-conjoined and/or non-reversed-conjoined adhesive tape end portions from adhesive tape rolls comprising:

a housing structure which includes a first wall panel and a second wall panel, an arc wall panel, up to four rotatable tape-roll hubs, at least one hollow through cylinder incorporated onto the first wall panel and at least one hollow through cylinder incorporated onto the second wall panel, a handle having a pivotable hanging hook, at least two cylindrical tape-bypass cantilevers, at least two cylindrical stand foot having a tape-cutting blade attached, and hardware for fastening parts onto the housing structure;

wherein the first wall panel is offset from the second wall panel, and having surfaces in different planes and having surfaces being paralleled with one another;

said arc wall panel having a radius generating from a center of a front tape-roll hub positioned substantially at a middle of the first wall panel, and shares a same axis with the front tape-roll hub; said arc wall panel having an inside radius configured to be larger than the radius of a tape roll intended for use; said arc wall panel is substantially perpendicular to the first wall panel and the second wall panel; said arc wall panel is connected to the first wall panel at an upper end and lower end portion on a side edge of the arc wall panel and partially connected to the second wall panel on another side edge of the arc wall panel;

said first wall panel is configured so that an upper end of the first wall panel is connected to a front of the handle, said second wall panel is configured so that an upper end of the second wall panel is connected to a rear portion of the handle where the pivotable hanging hook is attached thereto, a bottom front portion of the first wall panel having one cylindrical stand foot incorporated perpendicularly to the first wall panel, and a bottom rear portion of the first wall panel having at least one cylindrical tape-bypass cantilever projected outwardly and perpendicularly from the first wall panel;

a bottom rear portion of the second wall panel having one cylindrical stand foot incorporated perpendicularly to the second wall panel, and a bottom front portion of the second wall panel having at least one cylindrical tape-bypass cantilever projected outwardly and perpendicularly from the second wall panel, said upper end of the arc wall panel is connected to the upper end of the first wall panel which is positioned under the handle, said arc wall panel is also connected to the first wall panel substantially at a bottom rear portion of the first wall panel and above the at least one cylindrical tape-bypass cantilever on the first wall panel;

said second wall panel is connected to a lower side edge portion of the arc wall panel, and extended toward a rear end of the multi-tape dispenser where at least one rear tape-roll hub is rotatably attached for at least one tape roll to be mounted onto;

and said housing structure having hardware for fastening parts onto the housing structure, said hardware selected from the group consisting of bolts, nuts, washers, springs and rivets.

2. The multi-tape dispenser according to claim 1, wherein the handle is extended in a longitudinal direction toward the rear end of the housing structure and is connected to the upper end of the first wall panel and an upper portion of the second wall panel; said handle is positioned above tape rolls mounted onto the front and the at least one rear tape-roll hub so that the user's hand can hold the handle without touching the tape rolls;

said handle having at least one key hole and at least one screw hole so that the multi-tape dispenser may be installed by screws or nails onto a wall surface;

said handle having a thumb rest;

said handle is fabricated with wall ridges longitudinally to increase rigidity and improve handle control;

a handle tubing covers said handle.

3. The multi-tape dispenser according to claim 1, wherein the pivotable hanging hook is attached to the rear portion of the handle and pivotable around an axis of the handle while having some friction to keep the pivotable hanging hook from pivoting freely;

said pivotable hanging hook having first end portion with a circular ring-like end, an extending portion, and a hook end portion, wherein the circular ring-like end, extending portion and hook end portion all have a same wall thickness;

said circular ring-like end is used for a rivet or a bolt to be fastened through with a spring washer in order for the pivotable hanging hook to be fastened to the rear end of the handle;

the extending portion of the pivotable hanging hook is extended outwardly perpendicular to the axis of the handle, and the hook end is bent generally toward a front end of the handle frame.

4. The multi-tape dispenser according to claim 1, wherein each cylindrical tape-bypass cantilever having a non-stick rolling sleeve rotatably installed so that the tape portions may roll by without being dragged.

5. The multi-tape dispenser according to claim 1, wherein the at least one hollow through cylinder on the first wall panel is incorporated substantially at a middle of the first wall panel and extended outwardly and perpendicularly to at least one side of the first wall panel where at least one tape roll hub is rotatably installed thereto, the at least one hollow through cylinder on the second wall panel is incorporated substantially at a middle rear portion of the second wall panel and extended outwardly and perpendicularly to at least one side of the second wall panel where at least one tape-roll hub is rotatably installed thereto;

each hollow through cylinder is at a center of at least one tape-roll hub and at least one tape roll; and at least one of the hollow through cylinders having at least one hollow-through hole so that a rivet may be used to fasten at least one tape-roll hub.

6. The multi-tape dispenser according to claim 1, wherein each tape-roll hub comprises a plurality of raised triangular spacers evenly spaced and radiated from a center of the tape-roll hub and fit within a bore opening of a tape-roll core;

at least one tape-roll hub is fastened to a hollow through cylinder by a rivet or bolt/nut; at least one tape-roll hub having a rolling-guide cylinder to reduce wobbling when a tape-roll hub rotates thereon.

7. The multi-tape dispenser according to claim 1, wherein at least one tape-roll hub comprises a distance from a base ring of said at least one tape-roll to the a face of said at least one tape-roll that is different than at least one other tape-roll;

said at least one tape-roll hub having a different diameter than said at least one other tape-roll.

8. The multi-tape dispenser according to claim 1, comprising a tape-roll hub incorporated on a protruding side of the second wall panel and being on the same side of the multi-tape dispenser as a front tape-roll hub positioned on a recessed side of the first wall panel or comprising a tape-roll hub positioned on a protruding side of the first wall panel and being on the same side of the multi-tape dispenser as a rear tape-roll hub positioned on a recessed side of the second wall panel;

wherein when a tape-roll hub is positioned on a protruding side of the first wall panel, said tape-roll hub has a same axis with said tape-roll hub positioned on the recessed side of the first wall panel.

9. The multi-tape dispenser according to claim 1, wherein when one front tape-roll hub is positioned on a recessed side of the first wall panel, one rear tape-roll hub is positioned on a recessed side of the second wall panel, and a rear tape-roll hub is positioned on a protruding side of the second wall panel said rear tape-roll hubs are rotatably installed on a same axis and rotatably fastened by a rivet or a bolt, at least one spring washer, and a wing nut;

said rear tape-roll hubs are arranged so that each rear tape roll mounted on each rear tape-roll hub having an overlapped edge to be reversed-conjoined with an adjacent edge of a front tape roll on the front tape-roll hub.

10. The multi-tape dispenser according to claim 1, wherein when one front tape-roll hub is positioned on a recessed side of the first wall panel, one rear tape-roll hub is positioned on a recessed side of the second wall panel, and a front tape-roll hub is positioned on a protruding side of the first wall panel; said front tape-roll hubs are rotatably installed on a same axis and rotatably fastened by a rivet, or a bolt, at least one spring washer, and a wing nut;

said front tape-roll hubs are arranged so that each front tape roll mounted on each front tape-roll hub having an overlapped edge being reversed-conjoined with an adjacent edge of a rear tape roll on the the rear tape-roll hub.

11. The multi-tape dispenser according to claim 1, wherein when two tape-roll hubs are positioned on both sides of the second wall panel with one tape-roll hub on a protruding side of the second wall panel, and the other tape-roll hub on a recessed side of the second wall panel and a tape roll on a recessed side of the first wall panel and a tape roll on on a protruding side of the second wall panel forming reversed-conjoined tape end portions dispensing forwardly toward a front.

12. The multi-tape dispenser according to claim 1, wherein the housing structure contains two tape-roll hubs positioned on the second wall panel being on a recessed side and on the protruding side of the second wall panel, and also having two tape-roll hubs positioned on a recessed side and on a protruding side of the first wall panel all for dispensing tape end portions without being reversed-conjoined rearwardly and forwardly.

13. The multi-tape dispenser according to claim 1, further comprising at least one tape depressing bar rotatably pressing against the tape;

said tape depressing bar having a rotatable sleeve tubing.

14. The multi-tape dispenser according to claim 1, wherein at least two cylindrical stand foot are configured so that the tape-cutting blades are snapped onto the at least two cylindrical stand foot.

* * * * *